United States Patent [19]

Rasmussen

[11] 4,305,231

[45] Dec. 15, 1981

[54] SINGLE HOUSING MULTI-SANDER ASSEMBLY

[76] Inventor: Aaron P. Rasmussen, 9606 Candy La., La Mesa, Calif. 92041

[21] Appl. No.: 103,912

[22] Filed: Dec. 17, 1979

[51] Int. Cl.[3] ..... B24B 21/04

[52] U.S. Cl. ..... 51/3; 51/148

[58] Field of Search ..... 51/3, 135 R, 148

[56] References Cited

U.S. PATENT DOCUMENTS

| | | | |
|---|---|---|---|
| 1,191,045 | 7/1916 | Verwer | 51/3 |
| 1,791,917 | 2/1931 | Winsor | 51/135 R X |
| 2,857,717 | 10/1958 | Edgemond | 51/148 X |
| 2,900,766 | 8/1959 | Robischung | 51/148 |
| 3,538,650 | 11/1970 | Pollak | 51/148 |
| 3,611,646 | 10/1971 | Cameron | 51/148 X |
| 4,061,126 | 12/1977 | Schlangen | 51/135 R X |

*Primary Examiner*—Gary L. Smith

*Attorney, Agent, or Firm*—Charles C. Logan, II

[57] ABSTRACT

A single housing multi-sander assembly having a drive wheel mounted on a drive shaft, an idler wheel, a ring-shaped housing surrounding the radial drum surface of the drive wheel, an idler wheel mounting assembly, and structure for supporting the idler wheel mounting assembly a predetermined distance from the drive wheel. A closed loop abrasive belt passes around the radial drum surfaces of the respective drive wheel and idler wheel. The ring-shaped housing has a pair of radially spaced split through ways in the radial surface of the ring-shaped housing which function to form a path through which the closed loop abrasive belt passes. The ring-shaped housing has a support land located adjacent each of the split through ways to provide a support surface against which the underside of the closed loop abrasive belt may be pressed during sanding operations. The drive wheel has a lateral disc-shaped support surface upon which an abrasive disc is supported thereby providing the multi-sander assembly with an abrasive disc on its frontal plane in ninety degree contiguity with an abrasive belt transported on its peripheral drum surface.

10 Claims, 6 Drawing Figures

SINGLE HOUSING MULTI-SANDER ASSEMBLY

BACKGROUND OF THE INVENTION

The invention relates to a sanding machine, and more specifically to a multi-sander assembly having both an abrasive belt and also an abrasive disc. The multi-sander assembly has been designed to support the abrasive disc on the frontal plane of the drive wheel in ninety degree contiguity with the abrasive belt transported on the peripheral drum surface of the drive wheel.

In the past, sanding machines have been known having only a single work station with a sanding disc. An example of such a structure is illustrated in U.S. Pat. No. 1,149,396. Other sanding machines have had multiple work stations and have utlilized both an abrasive belt and an abrasive roller located at the different work stations. An example of such a structure is illustrated in U.S. Pat. No. 1,153,479. Other previous sanding machines have also had structure which allowed the abrasive belt support assembly to be adjusted to various work angles. An example of such a structure is illustrated in U.S. Pat. No. 2,273,696.

It is an object of the invention to provide a novel sanding machine which allows for operational transition between belt and disc sanding modes by combining the sanding principles at a single work station.

It is also an object of the invention to provide a novel sanding machine with both the belt and disc sanding modes in a single housing to facilitate maximum dust evacuation with a minimum of mechanical structure.

It is also an object of the invention to provide a novel sanding machine which has simplified and minimized the number of moving parts thereby reducing manufacturing and maintenance costs.

It is also an object of the invention to provide an integrally guarded sanding machine that is resistant to vibration and low noise pollution.

It is also an object of the invention to provide a sanding machine having versatility in operation and convenience in use, with regard to position changes, locking mechanisms and abrasive replacements.

It is an additional object of the invention to provide a novel compact commercial quality sanding machine that is light in weight but rugged in construction.

It is a further object of the invention to provide a novel sanding machine having stable belt loading and tracking characteristics by reducing the free belt length and increasing drive wheel belt contact.

SUMMARY OF THE INVENTION

The novel single housing multi-sander assembly has been designed to provide a sanding machine with the capabilities of both disc sanding and belt sanding operations at a single work station. The sander assembly and the drive wheel whose one lateral side supports an abrasive disc, while its peripheral drum surface supports an abrasive belt to provide ninety degree contiguity between the two abrasive members.

A ring-shaped housing surrounds the radial durm surface of the drive wheel thereby forming a protective guard structure for the radial drum surface of the drive wheel. This housing provides structure for securing attachments for the machine. The principle features of the ring-shaped housing include a split boss for attachment and radial adjustment of the head bar, a pair of radially spaced split through ways and extended lands for passage and support of the abrasive belt, and a depressed evacuation cavity adjacent its bottom radial surface for receiving standard vacum attachments. The rear of the ring-shaped housing has a radial groove that allows the housing to assume position variations on the radial adapter mount.

The radial adapter mount is bolted positively to the ring of a standard C frame motor. Its peripheral surface interfaces with the ring groove cut in the rear lateral face of the ring-shaped housing which in turn permits radial adjustment. The base of the adapter has a welded angle bar which functions as a stand for the sander assembly and motor.

The belt rest is interchangable to the left or right side of the ring-shaped housing as required. It is designed to permit vertical adjustment to accommodate backing plate or free belt sanding.

The cover plate satisfies the functions of guarding the abrasive disc, containing the dust particulate within the ring-shaped housing, and supporting the disc table. The cover plate is designed to revolve and can be easily removed from its radially cut slot mounts.

The disc table offers work support for disc sanding. It is fully angle adjustable through 45 degrees and carries miter attachment in its slot passageway. The through or open design of the slot allows particulate to drop through and simplifies locking the adjustable miter plate. The miter plate and its attendant locking structure permits it to travel freely in the disc table slot or if placed in the off set position, permits the plate to be locked at any desired angle to the face of the disc. The idler wheel. mounting assembly has an idler head formed of a single piece casting that has been milled to support the wheel axle at a blind locating hole in one side of the head. A slotted adjustment hole is formed in the opposite side of the head. In communication with the slot, designed to affect the tracking adjustment, is a threaded passageway for the adjuster screw. A bored hole in the bottom of the idler head functions to receive the head bar and permits the idler head to reciprocate slightly under spring and belt tension. Depressing the head against the spring and toward the ring-shaped housing allows the operator to quickly change the abrasive belt. A milled slot following the wedge tapered contour of the idler head inter-faces with the head cover tabs to secure that guard in place.

DESCRIPTION OF THE PREFERRED EMBODIMENT

Figure 1:
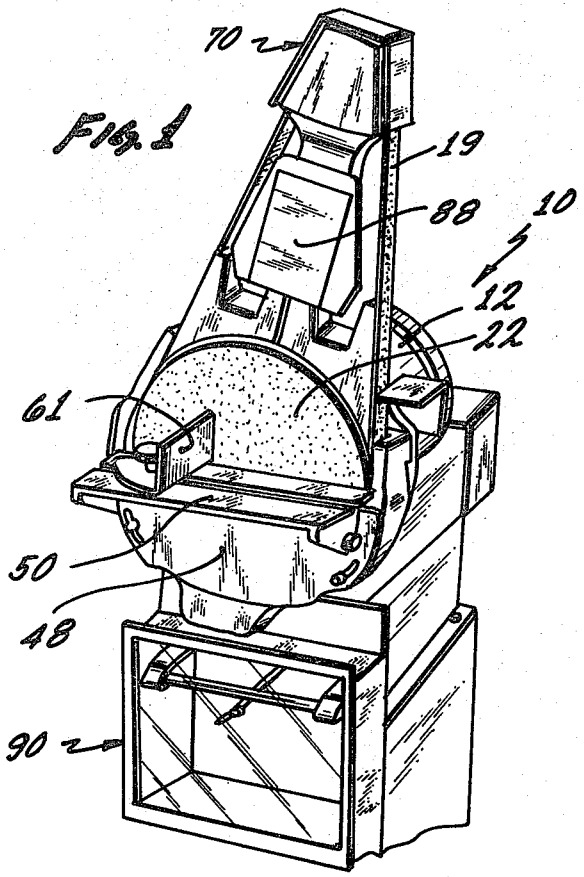
FIG. 1 is a front perspective view of the novel single housing multi-sander assembly.
Figure 2:
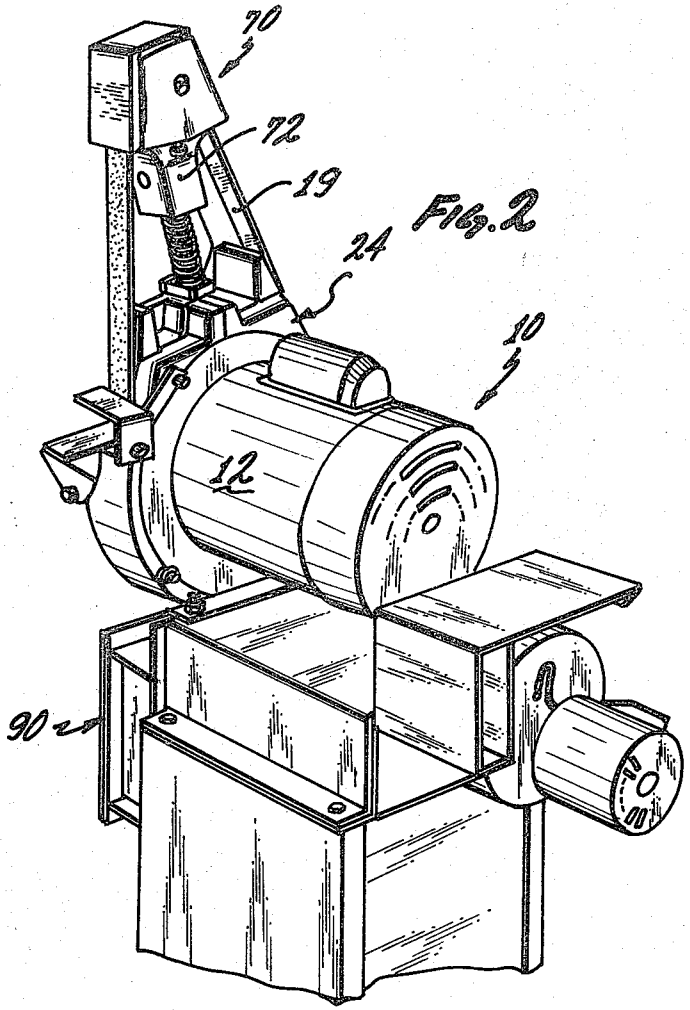
FIG. 2 is a rear perspective view of the novel single housing multi-sander assembly.
Figure 3B:
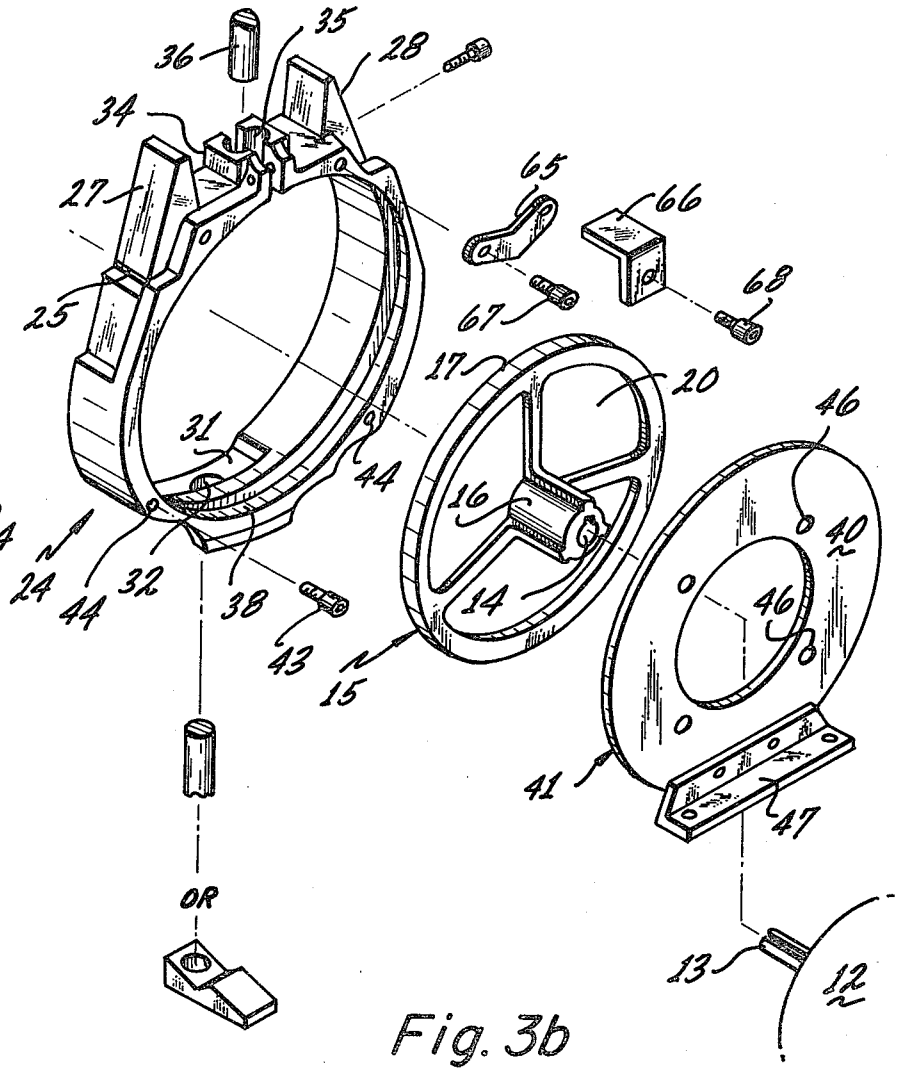
FIG. 3*b* is an exploded perspective view of the ring-shaped housing and the structure which is attached to its right side.
Figure 3A:
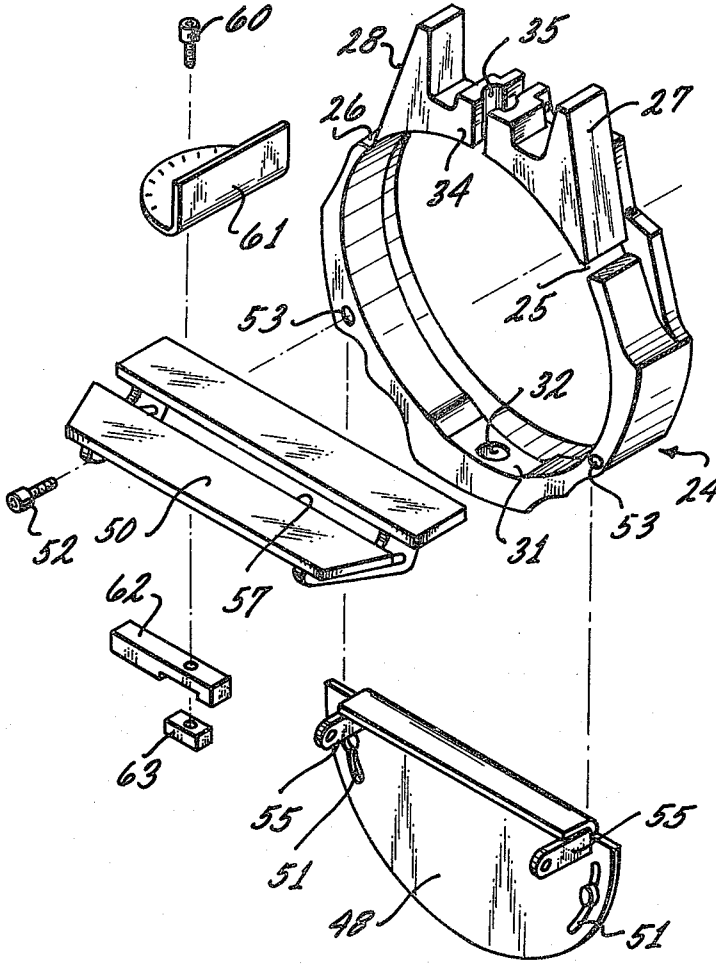
FIG. 3*a* is an exploded perspective view of the ring-shaped housing and the structure which is attached to its left side.

Novel single housing multi-sander assembly will be described by referring to FIGS. 1–5. The single housing multi-sander assembly is generally designated numeral 10. It has a C frame motor 12 having a drive shaft 13 that is removably received in bore hole 14 of the drive wheel 15. Drive wheel 15 is secured in position on drive shaft 13 by a set screw passing radially through hub 16. Drive wheel 15 has a radial drum surface 17 for frictionally driving closed loop abrasive belt 19. Drive wheel 15 also has a lateral disc-shaped support surface 20 upon which an abrasive disc 22 is supported.

A ring-shaped housing 24 surrounds the radial drum surface 17 of the drive wheel thereby forming a protective guard structure for the radial drum surface of the drive wheel. Ring-shaped housing 24 has a pair of radially spaced split through ways 25 and 26 which functions to form a path through which the closed loop abrasive belt 19 passes. Support lands 27 and 28 respectively, are located adjacent the split through ways 25 and 26 and provide a support surface against which the under side of abrasive belt 19 may be pressed during sanding operations performed by the abrasive belt. An evacuation cavity 31 is formed in the bottom of ring-shaped housing 24 and it has a bore hole 32 to receive standard vacuum attachments. The ring-shaped housing 24 has a boss member 34 extending radially upwardly from its top surface. It has an axially extending bore 35 and the boss member 34 is laterally split from top to bottom. Head support bar 36 is secured in the split boss 34 of the housing and it telescopes into bore hole 35. The rear face of ring-shaped housing 24 has a radial groove 38 of a diameter only slightly larger than the diameter of the disc portion 40 of radial adapter mount 41. Disc portion 40 is frictionally secured in any desired radial relationship with ring-shaped housing 24 by means of threaded screws 43 that are received in threaded bores 44 with the shoulders of screws 43 engaging disc portion 40 to hold it securely in any desired position. The radial adapter mount itself is positively bolted to a ring on the C frame motor 12 by bolts passing through apertures 46. At its base, the radial adapter mount 41 has a welded angle bar 47 which functions as a stand for the multi-sander assembly 10.

Cover plate 48 functions to guard the abrasive disc, contain the dust particulate within ring-shaped housing 24, and supports table disc 50. Cover plate 48 has radially cut slot mounts 51 so that it can be removed from the supporting screws 52 that are removably received in threaded bores 53. The disc table 50 is pivotally adjustable about arms 55 extending outwardly from cover plate 48. A slot 57 in disc table 50 allows the particulate to drop through and simplifies locking the adjustable miter plate assembly that is comprised of screw 60, miter plate 61, lock 62, and nut 63.

A belt rest assembly is interchangeably mountable on either the left or right of the ring-shaped housing 24 as required. It has a bracket 65, belt rest 66, and screws 67 and 68.

Figure 4:
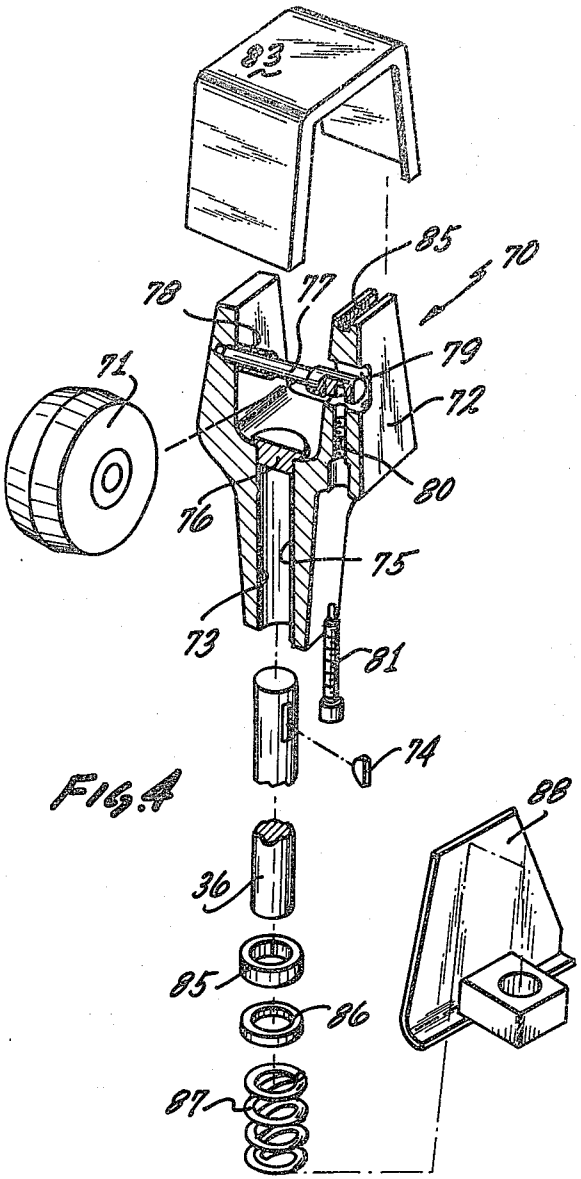
FIG. 4 is an exploded perspective view of the idler wheel mounting assembly; and, FIG. 5 is an exploded perspective view of the dust evacuation assembly.

The idler wheel mounting assembly 70 will be described by referring to FIG. 4. The idler head 72 has a vertical bore 73 in its bottom surface for receiving head support bar 36. Alignment is maintained by key 74 in key way 75. A plug 76 closes the top of vertical bores 73, idler wheel 71 is supported on wheel axle 77 which has its one end supported in blind locating hole 78 and its other end supported in slotted adjustment hold 79. In communication with slotted adjustment hole 79, is a threaded passage way 80 for adjuster screw 81. Head cover 83 interfaces with slot 85 to secure the head guard in place.

Mounted on the head support bar 36 between boss member 34 and the idler wheel mounting assembly 70 is structure for resiliently biasing the idler wheel mounting assembly upwardly. It consists of rubber damper 85, washer 86, spring 87, and identification plate unit 88.

Figure 5:
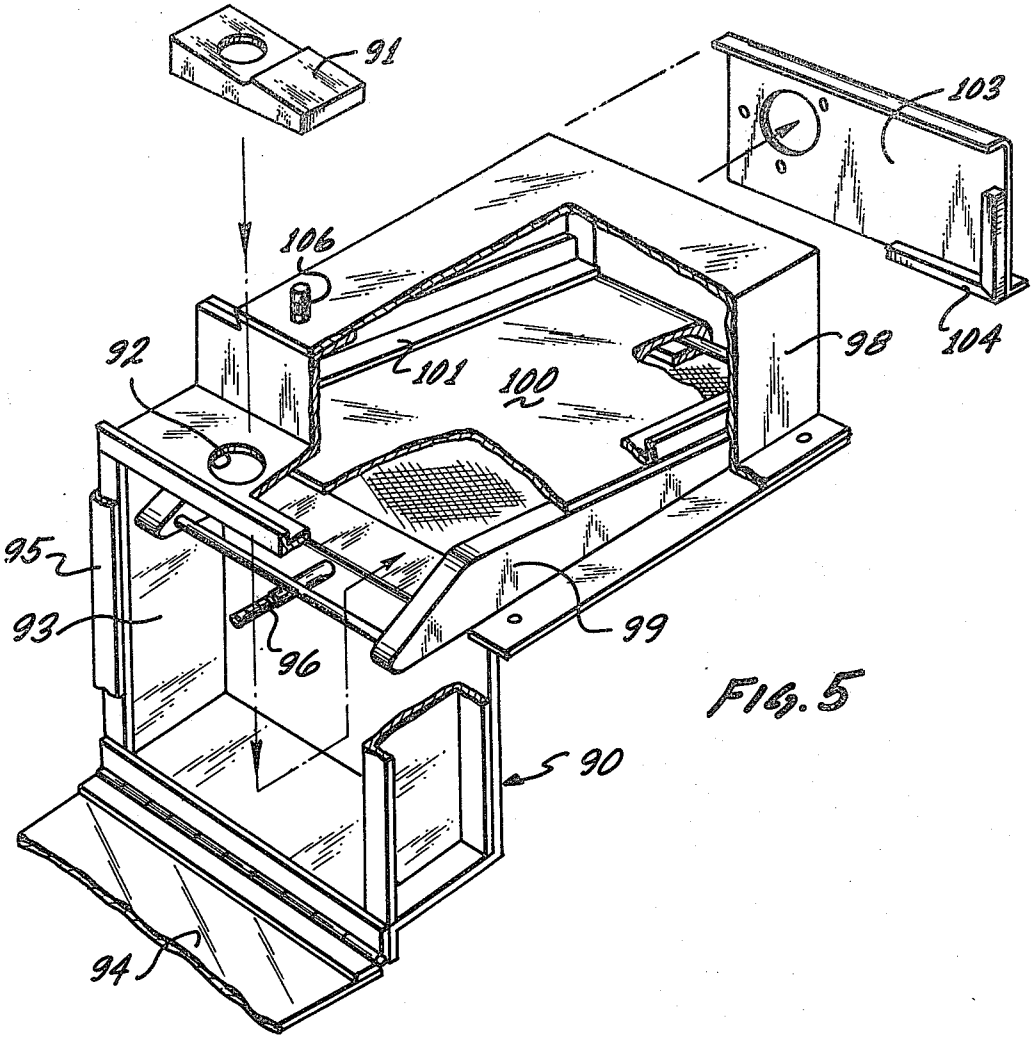

The dust evacuation assembly 90 is best described by reference to FIG. 5. It has a coupling seal 91 that is aligned with entry port 92 of collector box 93. A window 94 is pivotally hinged at its bottom to the front of collector box 93 and gasket 95 seals the space between the two members. A window stud 96 extends outwardly from the back wall of collector box 93. Filter box 98 has a wedge shaped carrier 99 a filter 100 and filter rails 101. An exhaust plate 103 has a plate gasket 104 and these close the rear wall of filter box 98. Extending upwardly from the top of filter box 40 are adapter mount studs 106.

What is claimed is:

1. A single housing multi-sander assembly compring: a drive shaft and means for rotating said drive shaft;

a drive wheel mounted on said drive shaft, said drive wheel having a lateral disc-shaped support surface upon which an abrasive disc is supported, said drive wheel also having a radial drum surface around which is frictionally drawn a closed loop abrasive belt;

an idler wheel having a radial drum surface that frictionally engages the inner surface of said closed loop abrasive belt;

a ring-shaped housing surrounding the radial drum surface of said drive wheel thereby forming a protective guard structure for the radial drum surface of said drive wheel;

an idler wheel mounting assembly; and said ring-shaped housing providing a supporting base to means for supporting said idler wheel mounting assembly a predetermined distance from said drive wheel.

2. A single housing multi-sander assembly as recited in claim 1 wherein said ring-shaped housing has a pair of radially spaced split through ways in the radial surface of of said ring-shaped housing which function to form a path through which said closed loop abrasive belt passes.

3. A single housing multi-sander assembly as recited in claim 2 wherein said ring-shaped housing has a support land located adjacent at least one of said split through ways to provide a support surface against which the underside of said closed loop abrasive belt may be pressed during sanding operations performed by the abrasive belt.

4. A single housing multi-sander assembly as recited in claim 1 wherein said ring-shaped housing has an evacuation cavity in its radial surface for receiving vacuum attachments used to evacuate dust and other waste products produced during the sanding operations.

5. A single housing multi-sander assembly as recited in claim 1 further comprising means for providing left or right rotation capability of the relative stationary position of said ring-shaped housing about said drive shaft thereby allowing the multi-sander assembly to operate at a multitude of tilted radial angles.

6. A single housing multi-sander assembly as recited in claim 5 wherein said means for providing left or right rotation of said ring-shaped housing comprises:

said ring-shaped housing having a radial groove of a predetermined diameter adjacent one of its lateral ends;

a radial adapter mount having a diameter such that it can be positioned within said radial groove; and means for frictionally clamping said radial adapter mount in a fixed position against said ring-shaped housing.

7. A single housing multi-sander assembly as recited in claim 1 further comprising a work station table for said abrasive disc work area and means for mounting it on one lateral side of said ring-shaped housing.

8. A single housing multi-sander assembly as recited in claim 1 wherein said ring-shaped housing has a boss member extending radially upwardly from its top surface, said boss member having an axially extending bore, said boss member being laterally split from bottom to top and having means to squeeze said boss member laterally together.

9. A single housing multi-sander assembly as recited in claim 8 wherein said means for supporting said idler wheel assembly comprises a support bar whose bottom end is telescopically received in the bore of said boss member and whose top end is telescopically recieved in a bore located in the bottom of said idler wheel assembly.

10. A single housing multi-sander assembly as recited in claim 4 further comprising a dust evacuator assembly in communication with said evacuation cavity.

* * * * *